US011067298B2

(12) United States Patent
Kim et al.

(10) Patent No.: US 11,067,298 B2
(45) Date of Patent: Jul. 20, 2021

(54) AIR CONDITIONER

(71) Applicant: Samsung Electronics Co., Ltd, Suwon-si (KR)

(72) Inventors: Ki Jun Kim, Suwon-si (KR); Dae Dong Kim, Yongin-si (KR); Se Woong Youn, Hwaseong-si (KR); Chang Heon Lee, Yongin-si (KR); Min Gu Jeon, Suwon-si (KR); Sang Ki Cho, Suwon-si (KR); Do-Hoon Kim, Suwon-si (KR); Jong Moon Lee, Suwon-si (KR); Jun Hwang, Suwon-si (KR); Keun Jeong Jang, Yongin-si (KR); Jung Won Kim, Suwon-si (KR); Se Joo Na, Hwaseong-si (KR); Bu Youn Lee, Hwaseong-si (KR); Hyeong Kyu Cho, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 275 days.

(21) Appl. No.: 16/192,466

(22) Filed: Nov. 15, 2018

(65) Prior Publication Data

US 2019/0219277 A1 Jul. 18, 2019

(30) Foreign Application Priority Data

Jan. 17, 2018 (KR) ..... 10-2018-0005932

(51) Int. Cl.
*F24F 1/0011* (2019.01)
*F24F 13/10* (2006.01)
(Continued)

(52) U.S. Cl.
CPC ..... *F24F 1/0011* (2013.01); *F24F 11/74* (2018.01); *F24F 13/082* (2013.01); *F24F 13/10* (2013.01);
(Continued)

(58) Field of Classification Search
CPC ..... F24F 1/0011; F24F 13/10; F24F 13/082; F24F 11/74; F24F 2013/205;
(Continued)

(56) References Cited

U.S. PATENT DOCUMENTS 8,230,693 B2 * 7/2012 Tsuji ..... F24F 1/0007 62/262
2017/0016633 A1 1/2017 Jeon et al.

FOREIGN PATENT DOCUMENTS

CN 106949615 A 7/2017
EP 3315871 A2 5/2018
(Continued)

OTHER PUBLICATIONS

International Search Report dated Mar. 7, 2019 in connection with International Patent Application No. PCT/KR2018/013530, 3 pages.
(Continued)

*Primary Examiner* — Ana M Vazquez

(57) ABSTRACT

Disclosed is an air conditioner to prevent deterioration of cooling or heating performance caused by re-introduction of cooling or heating air into a heat exchanger. The air conditioner includes a housing including an air discharge plate having a plurality of holes and an outlet, a heat exchanger located inside the housing, a blower fan configured to blow air heat-exchanged with the heat exchanger toward the air discharge plate or the outlet, a blade rotating between a guide position to guide a direction of air blown from the blower fan and discharged through the outlet and a closing position to close the outlet, wherein the blade includes a first blade and a second blade spaced apart from the first blade and configured to guide air blown from the blower fan toward the air discharge plate when the first blade is located at the closing position.

20 Claims, 14 Drawing Sheets

(51) Int. Cl.

| | |
|---|---|
| ***F24F 13/08*** | (2006.01) |
| ***F24F 11/74*** | (2018.01) |
| ***F24F 13/20*** | (2006.01) |
| ***F24F 1/0003*** | (2019.01) |

(52) U.S. Cl.
CPC ..... *F24F 1/0003* (2013.01); *F24F 2013/205* (2013.01)

(58) Field of Classification Search
CPC ..... F24F 1/0003; F24F 1/0047; F24F 13/068; F24F 1/0057; F24F 13/14
USPC ..... 165/126; 62/426
See application file for complete search history.

(56) References Cited

FOREIGN PATENT DOCUMENTS

| | | | |
|---|---|---|---|
| EP | 3396266 | A1 | 10/2018 |
| EP | 3667193 | A1 | 6/2020 |
| JP | H07234006 | | 9/1995 |
| JP | 2014-196882 | A | 10/2014 |
| KR | 20-2001-0001964 | U | 1/2001 |
| KR | 10-2006-0115484 | A | 11/2006 |
| KR | 10-2007-0073142 | A | 7/2007 |
| KR | 10-0787501 | B1 | 12/2007 |
| KR | 10-2009-0010451 | A | 1/2009 |
| KR | 10-1166375 | B1 | 7/2012 |
| KR | 10-1698842 | B1 | 1/2017 |

OTHER PUBLICATIONS

Supplementary European Search Report dated Jan. 19, 2021 in connection with European Patent Application No. 18 901 404.6, 8 pages.

* cited by examiner

AIR CONDITIONER

CROSS-REFERENCE TO RELATED APPLICATIONS

This application is based on and claims priority under 35 U.S.C. § 119 to Korean Patent Application No. 10-2018-0005932 filed on Jan. 17, 2018 in the Korean Intellectual Property Office, the disclosure of which is incorporated herein by reference in its entirety.

BACKGROUND

1. Field

Embodiments of the present disclosure relate to an air conditioner, and more particularly, to an air conditioner discharging air using different methods and having improved capability of controlling discharged air flows.

2. Description of the Related Art

In general, an air conditioner refers to an apparatus that adjusts temperature, humidity, air flow, air distribution, and the like to provide an environment suitable for human activity by using a refrigeration cycle. The refrigeration cycle may include a compressor, a condenser, an evaporator, and a blower fan as main components.

Air conditioners may be classified into split type air conditioners in which an indoor unit and an outdoor unit are separately installed and integrated type air conditioners in which both an indoor unit and an outdoors unit are installed in a cabinet. Among them, an indoor unit of a split type air conditioner includes a heat exchanger that exchanges heat with air introduced into a panel and a blower fan that draws air from an indoor room into the panel and returns the drawn air to the indoor room.

Indoor units of conventional air conditioners have been designed to minimize heat exchangers and maximize velocities and amounts of winds by increasing RPM of a blower fan. Thus, temperature of discharged air decreases and air is discharged to an indoor space after passing through a narrow and long air flow path.

When discharged air is brought into direct contact with a user, the user may have cold and uncomfortable feelings. On the contrary, when discharged air is not brought into contact with the user, the user may have hot and uncomfortable feels.

In addition, an increase in the RPM of the blower fan to obtain a high velocity of wind, noise may be increased. In the case of a radiation air conditioner that does not use a blower fan, a larger panel is required to provide the same air conditioning capability as those using the blow fan. In addition, cooling rates are very low and manufacturing costs are very high.

SUMMARY

Therefore, it is an aspect of the present disclosure to provide an air conditioner having various air discharging methods.

It is another aspect of the present disclosure to provide an air conditioner having improved capability of controlling air discharged through an air discharge port.

It is another aspect of the present disclosure to provide an air conditioner to prevent deterioration of cooling or heating performance caused by re-introduction of cooling or heating air into a heat exchanger.

Additional aspects of the disclosure will be set forth in part in the description which follows and, in part, will be obvious from the description, or may be learned by practice of the disclosure.

In accordance with one aspect of present disclosure, an air conditioner includes a housing including an air discharge plate having a plurality of holes and an outlet, a heat exchanger located inside the housing, a blower fan configured to blow air heat-exchanged with the heat exchanger toward the air discharge plate or the outlet, a blade rotating between a guide position to guide a direction of air blown from the blower fan and discharged through the outlet and a closing position to close the outlet, wherein the blade includes a first blade having a plurality of blade holes and a size corresponding to that of the outlet, and a second blade spaced apart from the first blade and configured to guide air blown from the blower fan toward the air discharge plate when the first blade is located at the closing position.

The second blade may be integrated with the first blade and moves together with the first blade to the guide position or the closing position.

The air conditioner may further include a connecting blade to connect the first blade with the second blade.

The connecting blade may form an inflow port through which air flows in and an outflow port through which air is discharged together with the first blade and the second blade.

The outflow port may be provided smaller than the inflow port to have a velocity of air discharged out of the outflow port greater than a velocity of air introduced into the inflow port.

The second blade may include a plurality of second blades arranged along a lengthwise direction of the first blade.

A rotary shaft of the blade may be located at the connecting blade.

The second blade may reduce an amount of air passing through the blade holes of the first blade among air flows blown from the blower fan when the blade is located in the guide position.

The second blade may be inclined with respect to the first blade.

The rotary shaft of the blade may be located closer to a front end of the outlet than a rear end of the outlet.

In accordance with one aspect of present disclosure, an air conditioner includes a housing mounted on or recessed in a ceiling and having an inlet port and an air discharge port, a heat exchanger located inside the housing, a blower fan configured to draw air into the housing through the inlet port and discharge air out of the housing through the air discharge port, a first blade configured to open or close the air discharge port, having a plurality of blade holes, and provided to discharge air through the plurality of blade holes, and a second blade spaced apart from the first blade and configured to reduce an amount of air passing through the blade holes when the first blades opens the air discharge port.

The air conditioner may further include a first opening formed between one side of the first blade closer to the inlet port and the housing when the first blade opens the air discharge port, and a second opening formed between the other side of the first blade opposite to the one side and the housing when the first blade opens the air discharge port.

The second blade may increase an amount of air discharged through the first opening and the second opening by guiding air inside the housing toward the first opening and the second opening.

The housing may include a guide portion to guide air discharged through the first opening in a direction away from the inlet port.

The second blade may form a flow guide to guide air toward the blade holes when the first blade closes the air discharge port.

When the first blade opens the air discharge port, the second blade may guide air toward the guide portion and the guide portion may guide air discharged through the first opening to push air discharged through the blade holes in a direction away from the inlet port.

When the first blade opens the air discharge port, a velocity of air discharged through the first opening may be greater than a velocity of air discharged through the blade holes.

The second blade may include a plurality of second blades arranged along a lengthwise direction of the first blade.

The second blade may be located closer to one side of the first blade to increase an amount of air discharged through the first opening.

The second blade may be integrated with the first blade to rotate together therewith.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Definitions for certain words and phrases are provided throughout this patent document. Those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
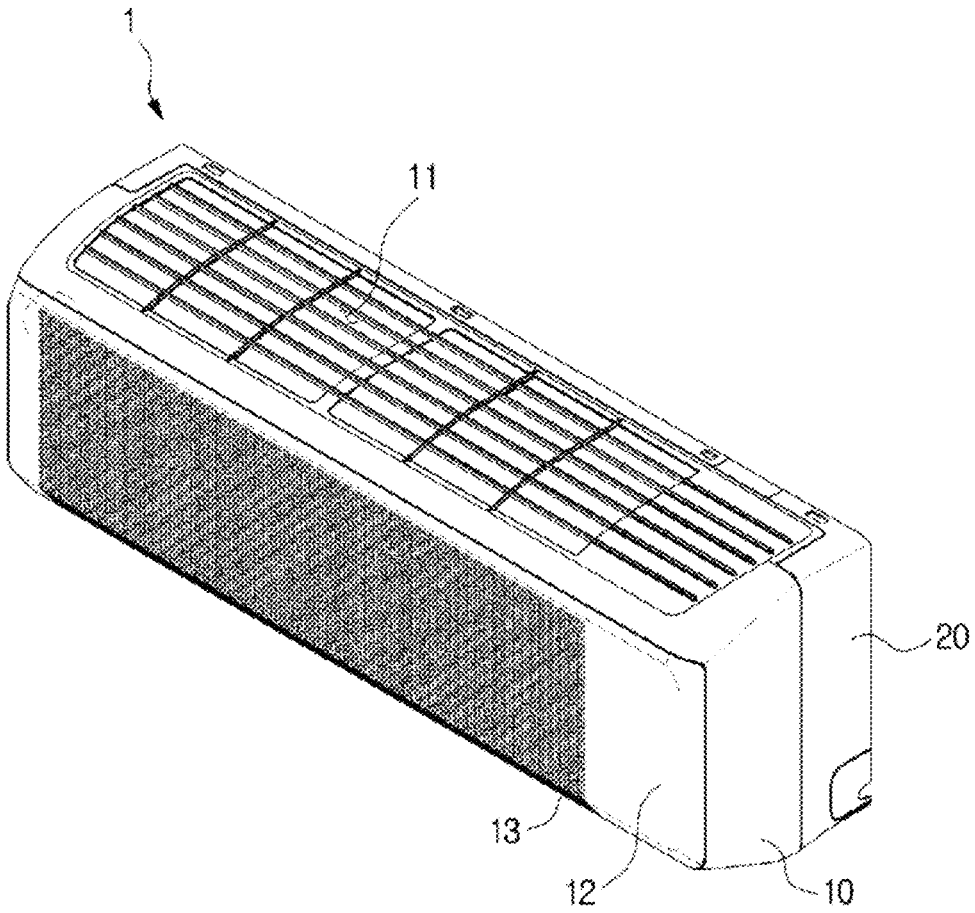
FIG. 1 illustrates a top perspective view of an air conditioner according to an embodiment.

FIGS. 1 through 14, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Reference will now be made in detail to the embodiments of the present disclosure, examples of which are illustrated in the accompanying drawings, wherein like reference numerals refer to like elements throughout.

The terms used in the present specification are merely used to describe particular embodiments, and are not intended to limit the present disclosure. An expression used in the singular encompasses the expression of the plural, unless it has a clearly different meaning in the context. In the present specification, it is to be understood that the terms such as "including" or "having" etc., are intended to indicate the existence of the features, numbers, operations, components, parts, or combinations thereof disclosed in the specification, and are not intended to preclude the possibility that one or more other features, numbers, operations, components, parts, or combinations thereof may exist or may be added.

It will be understood that, although the terms "first", "second", etc., may be used herein to describe various elements, these elements should not be limited by these terms. The above terms are used only to distinguish one component from another. For example, a first component discussed below could be termed a second component, and similarly, the second component may be termed the first component without departing from the teachings of this disclosure. As used herein, the term "and/or" includes any and all combinations of one or more of the associated listed items.

Hereinafter, embodiments of the present disclosure will be described in detail with reference to the accompanying drawings.

A refrigeration cycle of an air conditioner is performed by using a compressor, a condenser, an expansion valve, and an evaporator. A refrigerant undergoes a series of processes involving compression, condensation, expansion, and evaporation. After higher temperature air exchanges heat with a lower temperature refrigerant, low-temperature air is supplied to an indoor room.

The compressor compresses a refrigerant gas in a high-temperature and high-pressure state and discharges the compressed refrigerant gas. The discharged refrigerant gas flows into the condenser. The condenser condenses the compressed refrigerant into a liquid phase and heat is released to the surroundings via a condensation process. The expansion valve expands the liquid phase refrigerant in a high-temperature and high-pressure state condensed in the condenser into a liquid phase refrigerant in a low-pressure. The evaporator evaporates the refrigerant expanded in the expansion valve. The evaporator may achieve refrigeration effects via heat exchange with a material to be cooled using latent heat of evaporation of the refrigerant and returns the refrigerant gas in a low-temperature and low-pressure state to the compressor. The air conditioner may adjust temperature of an indoor space throughout this cycle.

An outdoor unit of the air conditioner refers to a part of the refrigeration cycle including a compressor and an outdoor heat exchanger. The expansion valve may be provided in the indoor unit or the outdoor unit and an indoor heat exchanger is located in the air conditioner.

When the indoor space needs to be cooled, the outdoor heat exchanger serves as a condenser and the indoor heat exchanger serves as an evaporator.

When the indoor space needs to be heated, the outdoor heat exchanger serves as an evaporator and the indoor heat exchanger serves as a condenser.

Hereinafter, an indoor unit including an indoor heat exchanger will be referred to as an air conditioner and the indoor heat exchanger will be referred to as a heat exchanger for descriptive convenience.

Figure 2:
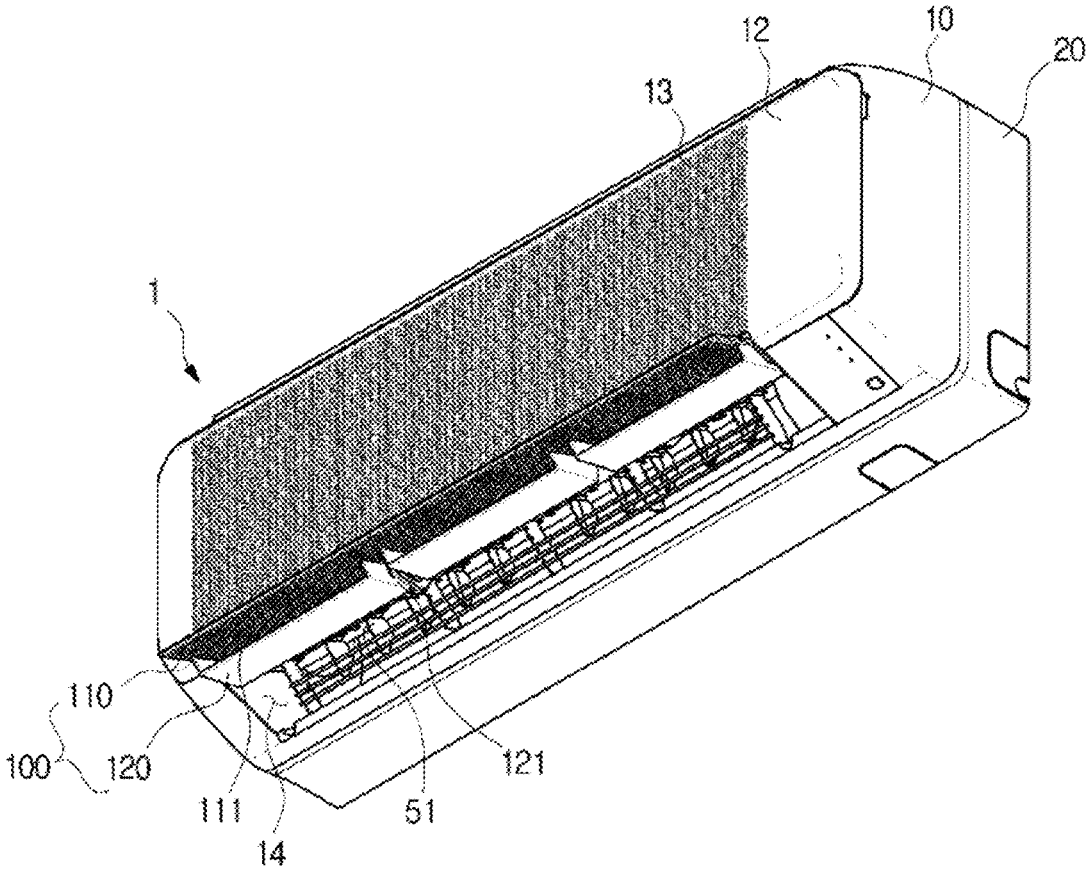
FIG. 2 illustrates a bottom perspective view of the air conditioner according to the embodiment.
Figure 3:
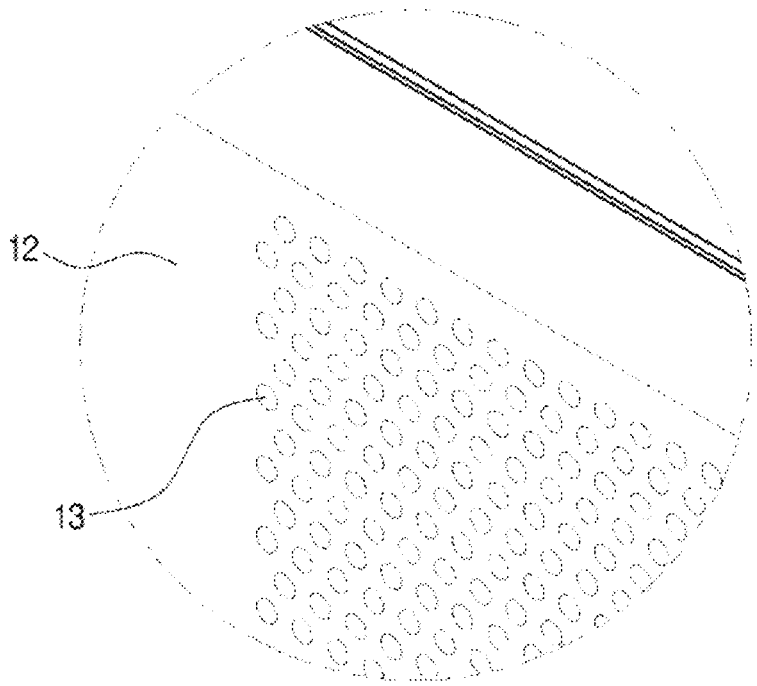
FIG. 3 illustrates an enlarged view of an air discharge plate according to the embodiment.
Figure 4:
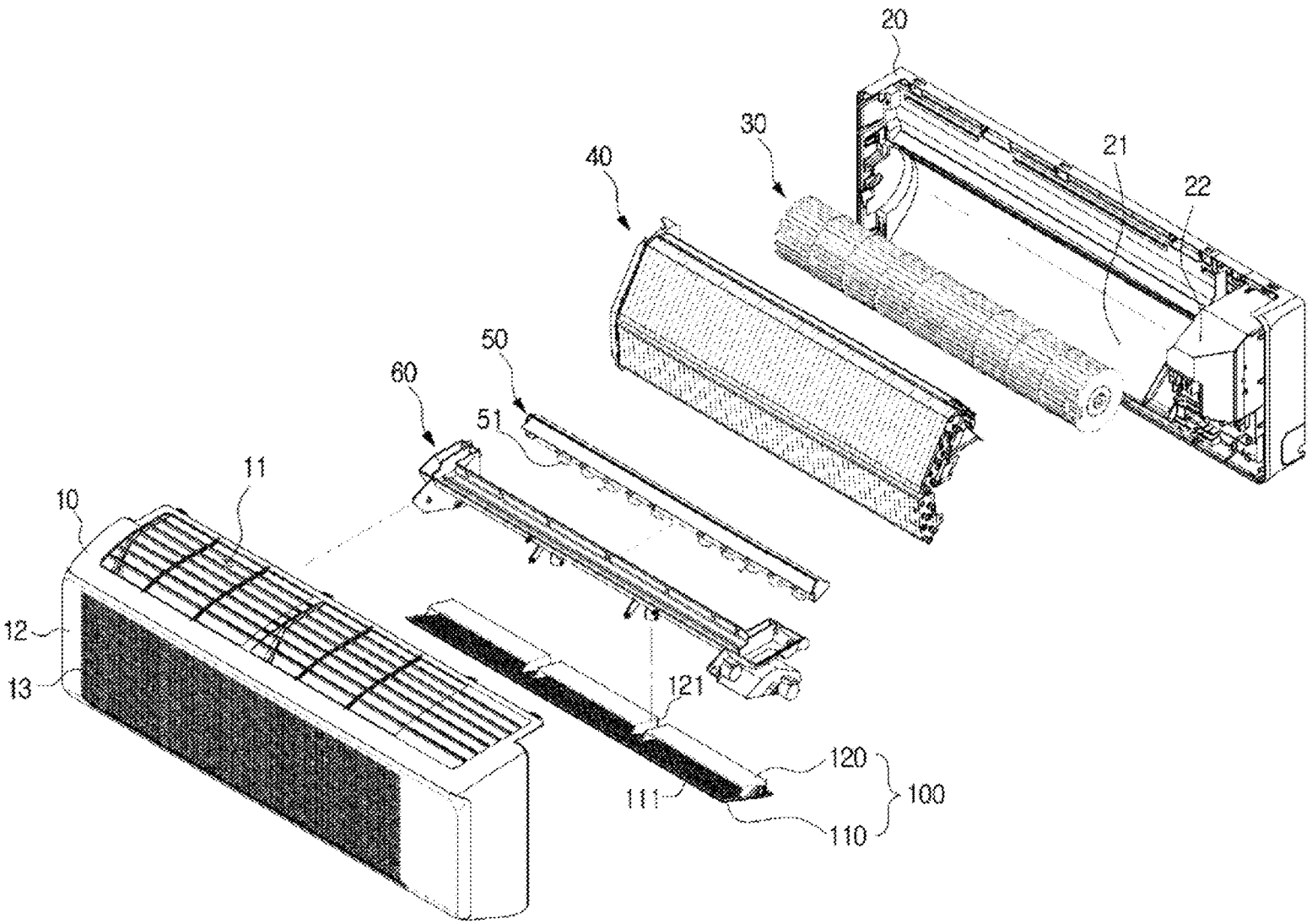
FIG. 4 illustrates an exploded view of the air conditioner according to the embodiment.

FIG. 1 illustrates a top perspective view of an air conditioner according to an embodiment. FIG. 2 illustrates a bottom perspective view of the air conditioner according to the embodiment. FIG. 3 illustrates an enlarged view of an air discharge plate according to the embodiment. FIG. 4 illustrates an exploded view of the air conditioner according to the embodiment.

An air conditioner 1 includes housings 10 and 20 having an inlet port 11 and an outlet 14, a heat exchanger 40 configured to exchange heat with air flowing into the housings 10 and 20, and a blower fan 30 configured to circulate air into or out of the housings 10 and 20.

A wall-mounted air conditioner 1 will be described as an example of the air conditioner 1 according to an embodiment, but the embodiment is not limited thereto.

The housings 10 and 20 may be formed to define the overall appearance of the air conditioner 1. The housings 10 and 20 may include an air discharge plate 12 having a plurality of holes 13. The air discharge plate 12 may be disposed on a front surface of the housings 10 and 20. The plurality of holes 13 may be distinguished from the outlet 14. The plurality of holes 13 may be distributed in a predetermined area of the air discharge plate 12 as illustrated in FIG. 3. However, the embodiment is not limited thereto, and the plurality of holes 13 may also be distributed in the entire area of the air discharge plate 12. Air may be discharged out of the housings 10 and 20 at a low speed through the plurality of holes 13 and a plurality of blade holes 111 which will be described later. Thus, a user may achieve the purpose of air conditioning with no direct contact with cool air, thereby having enhanced satisfaction.

The housings 10 and 20 may include a first housing 10 defining the front surface of the housings 10 and 20 and a second housing 20 covering a rear surface of the first housing 10.

The first housing 10 may have the inlet port 11 through which air is introduced and the outlet 14 through which the air is discharged. The inlet port 11 may be provided at the top surface of the first housing 10. The outlet 14 may be provided at the bottom surface of the first housing 10. When the air conditioner 1 according to an embodiment is mounted on a wall, the second housing 20 faces the wall, and thus the inlet port 11 or the outlet 14 may be formed in the first housing 10. Meanwhile, the inlet port 11 may also be provided at the bottom surface of the first housing 10 and the outlet 14 may also be provided at the top surface of the first housing 10.

The air discharge plate 12 may be coupled to the front surface of the first housing 10. The air discharge plate 12 is provided to cover the front surface of the first housing 10 and may have the plurality of holes 13 as described above. In addition, the air discharge plate 12 may form a second air flow path 72, which will be described later, together with the first housing 10.

The second housing 20 is coupled to the first housing 10. An operating device 22 including a fan motor configured to drive a blower fan, a circuit board configured to drive other components of the air conditioner 1, and the like may be provided in one portion of the second housing 20.

The second housing 20 may include a first air flow guide 21 defining a first air flow path 71 which will be described later.

The air conditioner 1 may include a blade 100 configured to open or close the outlet 14. The blade 100 may be rotatably provided at the housings 10 and 20. The blade 100 may rotate about a rotary shaft 101 of the blade 100. The rotary shaft 101 of the blade may be located in the housings 10 and 20.

The blade 100 may include a first blade 110 having the plurality of blade holes 111 and a second blade 120 smaller than the first blade 110 and spaced apart from the first blade 110.

The first blade 110 may have a size corresponding to that of the outlet 14. Thus, the first blade 110 may close the outlet 14. In this regard, air may be discharged out of the housings 10 and 20 through the blade holes 111 of the first blade 110. This will be described later.

The second blade 120 may not have blade holes. The second blade 120 may be provided smaller than the first blade 110 and plural in number. Although three second blades 120 are provided according to an embodiment, the embodiment is not limited thereto.

Figure 5:
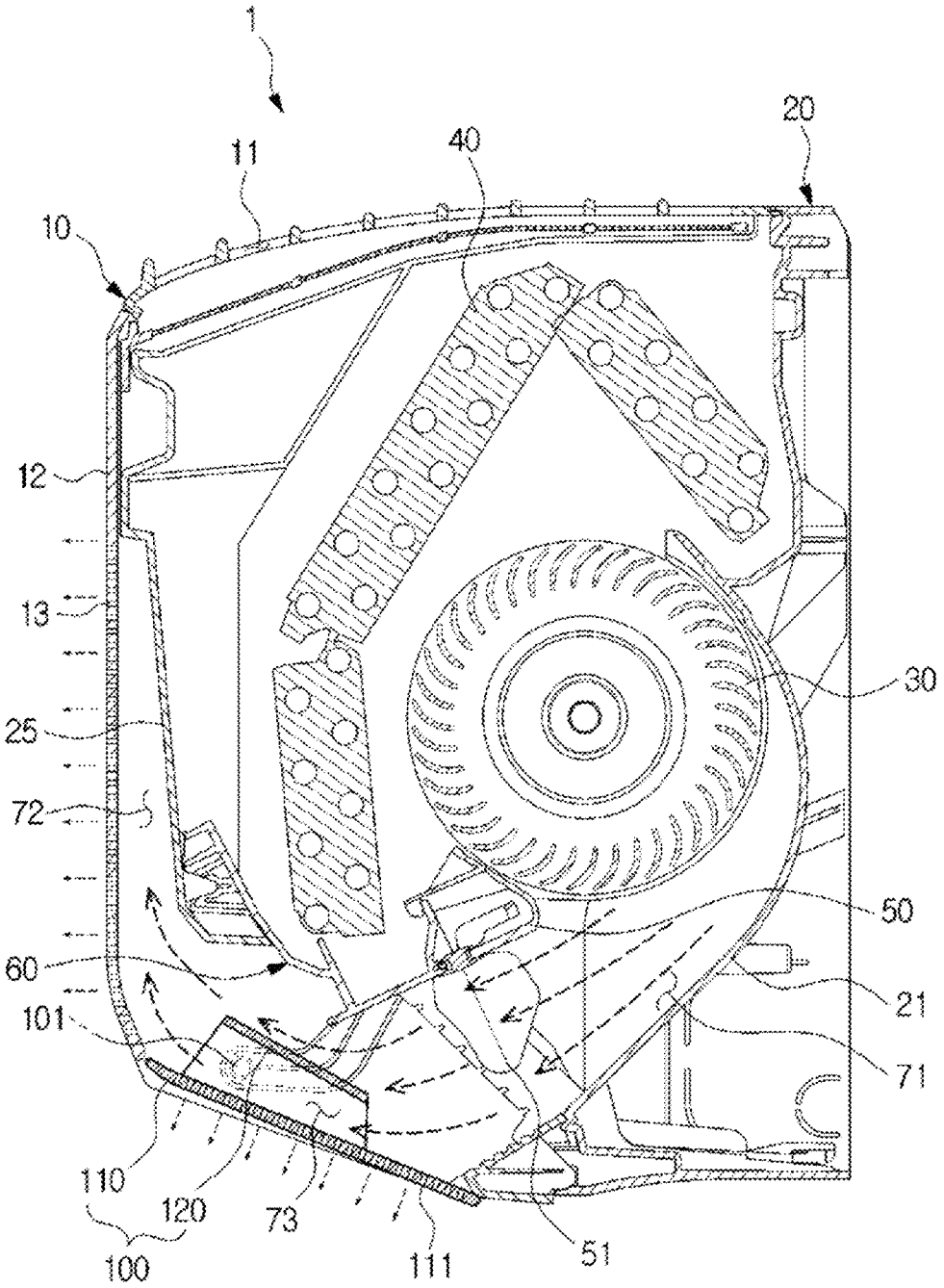
FIG. 5 illustrates a cross-sectional view of an air conditioner according to an embodiment operating in a minimum air volume mode.
Figure 7:
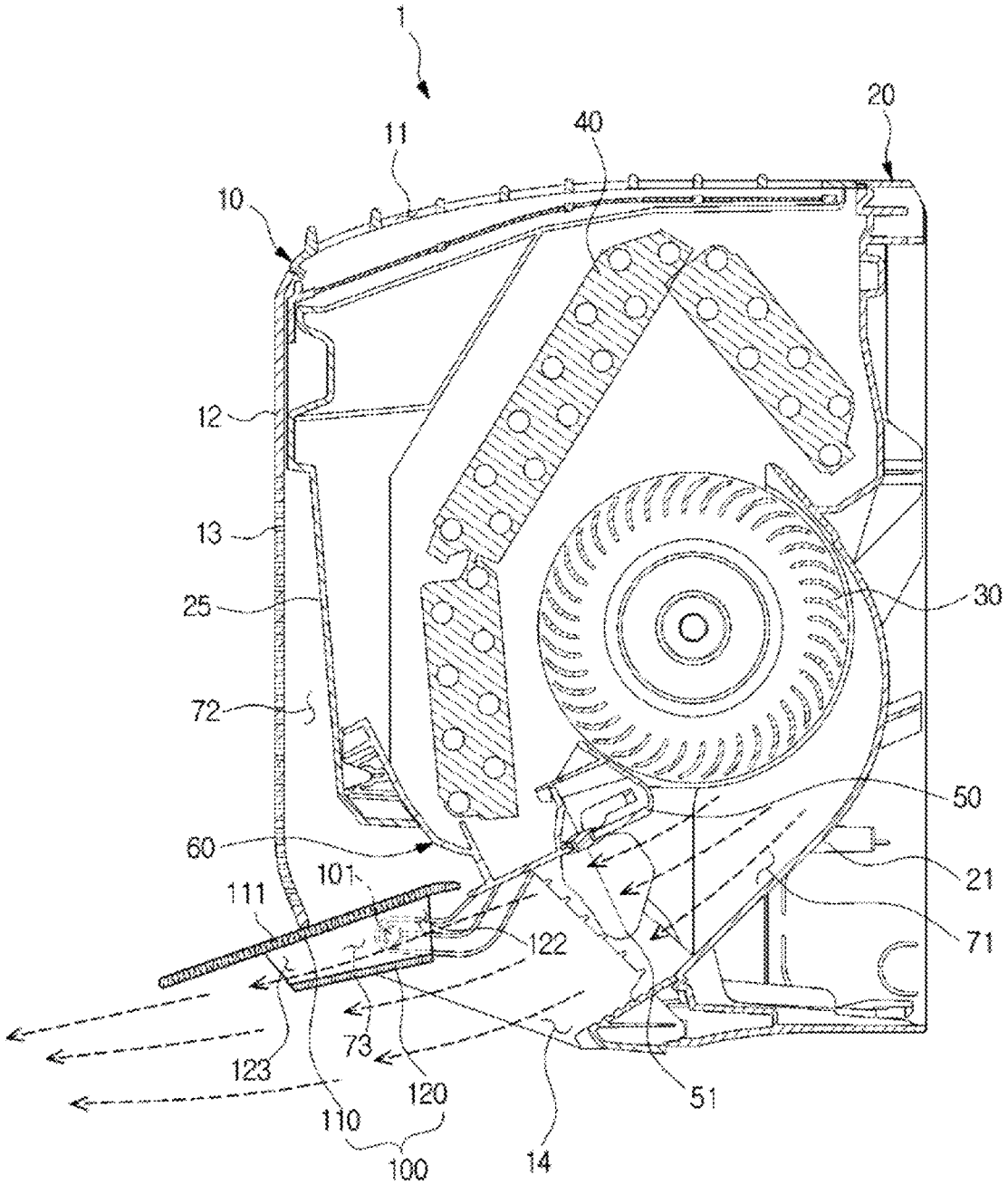
FIG. 7 illustrates a cross-sectional view of the air conditioner operating in a straight-ahead mode.
Figure 10:
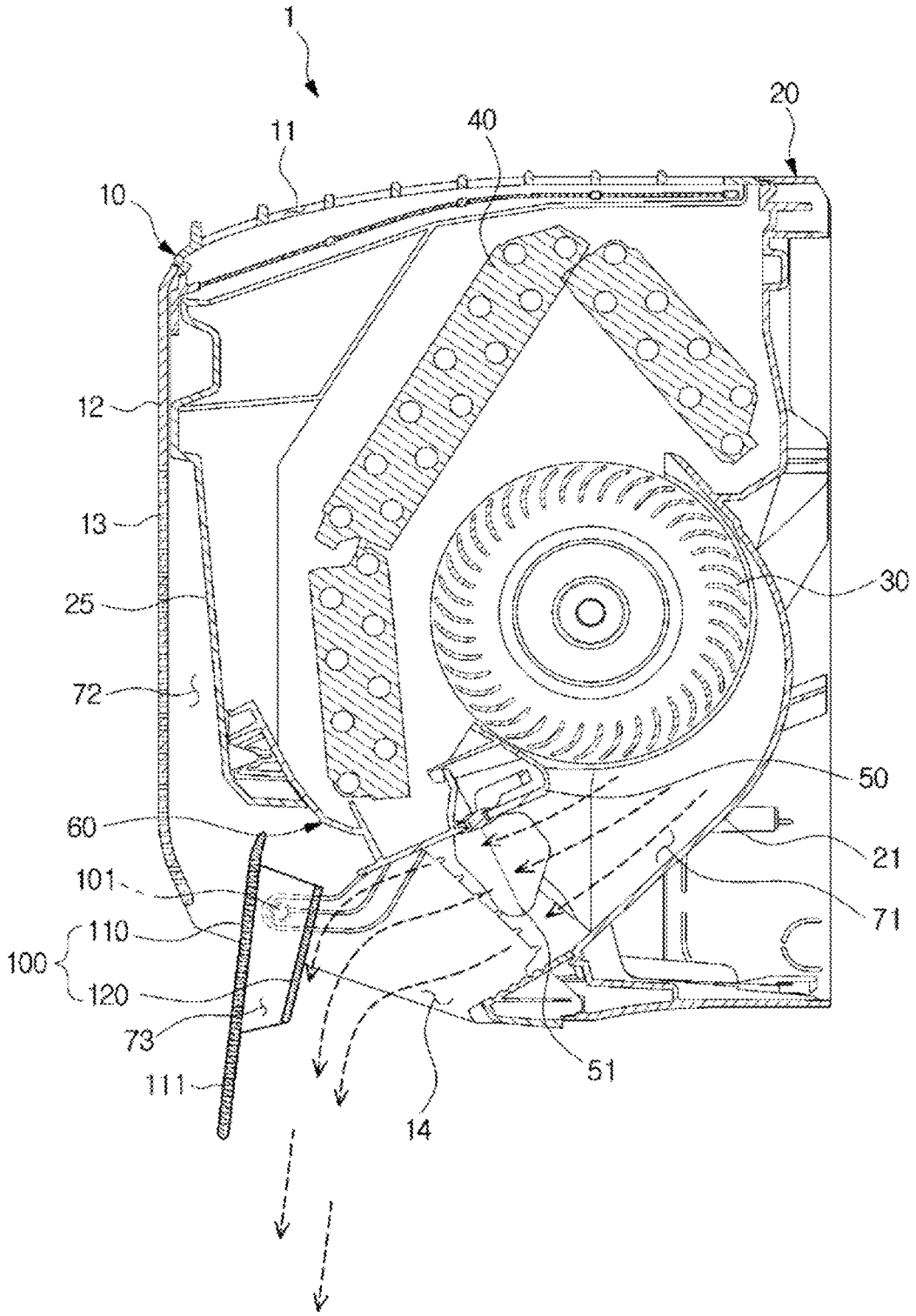
FIG. 10 is a cross-sectional view illustrating a downdraft mode of the air conditioner according to the embodiment.

The blade 100 may move to be located at a first position in which the blade 100 closes the outlet 14 to discharge air out of the housings 10 and 20 through the blade holes 111 of the first blade 110 and the plurality of holes 13 of the air discharge plate 12 (FIG. 5), a second position in which the blade 100 opens the outlet 14 to guide air discharged through the outlet 14 from the blower fan 30 straight ahead (FIG. 7), or a third position in which the blade 100 opens the outlet 14 to guide air discharged through the outlet 14 from the blower fan 30 downward (FIG. 10). Hereinafter, an operation mode of the air conditioner 1 in the first position is defined as a minimum air volume mode (FIG. 5). In addition, an operation mode of the air conditioner 1 in the second position is defined as a straight-ahead mode (FIG. 7). Also, an operation mode of the air conditioner 1 in the third position is defined as a downdraft mode (FIG. 10).

The air conditioner 1 may control air to be discharged from the blower fan 30 through the plurality of holes 13 of the air discharge plate 12 and the blade holes or directly through the outlet 14 by moving the blade 100 to be located at the first position (FIG. 5), the second position (FIG. 7), or the third position (FIG. 10).

The blower fan 30 may be located in the housings 10 and 20. The blower fan 30 may be a crossflow fan having the same lengthwise direction as those of the housings 10 and 20. The blower fan 30 may draw air into the inlet port 11 and blow the air to be discharged out of the outlet 14.

The heat exchanger 40 may be disposed to cover front and upper portions of the blower fan 30. The heat exchanger 40 may be disposed adjacent to the blower fan 30, for example, between the inlet port 11 and the blower fan 30. Thus, after external air is introduced into the inlet port 11, the air may be heat-exchanged with the heat exchanger and then discharged out through the outlet 14 or the blade holes 111 and the air discharge plate 12.

A drain panel 60 may be provided below the heat exchanger 40 to collect condensed water on the heat exchanger 40. Although not shown in the drawings, the drain panel 60 may be connected to a drain hose extending to the outside to drain the condensed water on the heat exchanger 40 out of the housings 10 and 20.

The drain panel 60 may be mounted with a stabilizer 50 configured to determine a direction of air blown from the blower fan 30. The stabilizer 50 may separate an inflow path of air drawn by the blower fan 30 from an outflow path of air discharged therefrom together with the drain panel 60. The stabilizer 50 may include a plurality of fins 51 to guide air in the transverse direction. The plurality of fins 51 may rotate laterally to guide the blown air in the transverse direction.

Also, the stabilizer 50 may constitute the first air flow path 71 together with the first air flow guide 21 which will be described later. The first air flow guide 21 may define a lower portion of the first air flow path 71 and the stabilizer 50 may define an upper portion of the first air flow path 71.

The air conditioner 1 may include an air flow guide. The air flow guide is configured to guide air blown from the blower fan 30.

The air flow guide may include the first air flow guide 21 and a second air flow guide 25.

The first air flow guide 21 is provided to form the first air flow path 71 in which air flows from the blower fan 30 to the outlet 14. The first air flow path 71 may be connected to the outlet 14. The outlet 14 may be located at an end of the first air flow guide 21. The outlet 14 may be located in a position extended from a flow path of the air guided by the first air flow guide 21.

The second air flow guide 25 is provided to form the second air flow path 72. The second air flow path 72 may be connected to the plurality of holes 13. Particularly, the second air flow path 72 is defined by the second air flow guide 25 and an inner surface of the air discharge plate 12. Air flowing in the second air flow path 72 may be discharged out of the housings 10 and 20 through the plurality of holes 13 of the air discharge plate 12.

The drain panel 60 and the stabilizer 50 may be located between the first air flow path 71 and the second air flow path 72. The drain panel 60 and the stabilizer 50 may prevent air from entering the heat exchanger 40 located above the drain panel 60 after passing through the first air flow path 71. When previously heat-exchanged air exchanges heat with the heat exchanger 40 again, heat exchange performance may deteriorate. Thus, the drain panel 60 and the stabilizer 50 may prevent this phenomenon.

Figure 6:
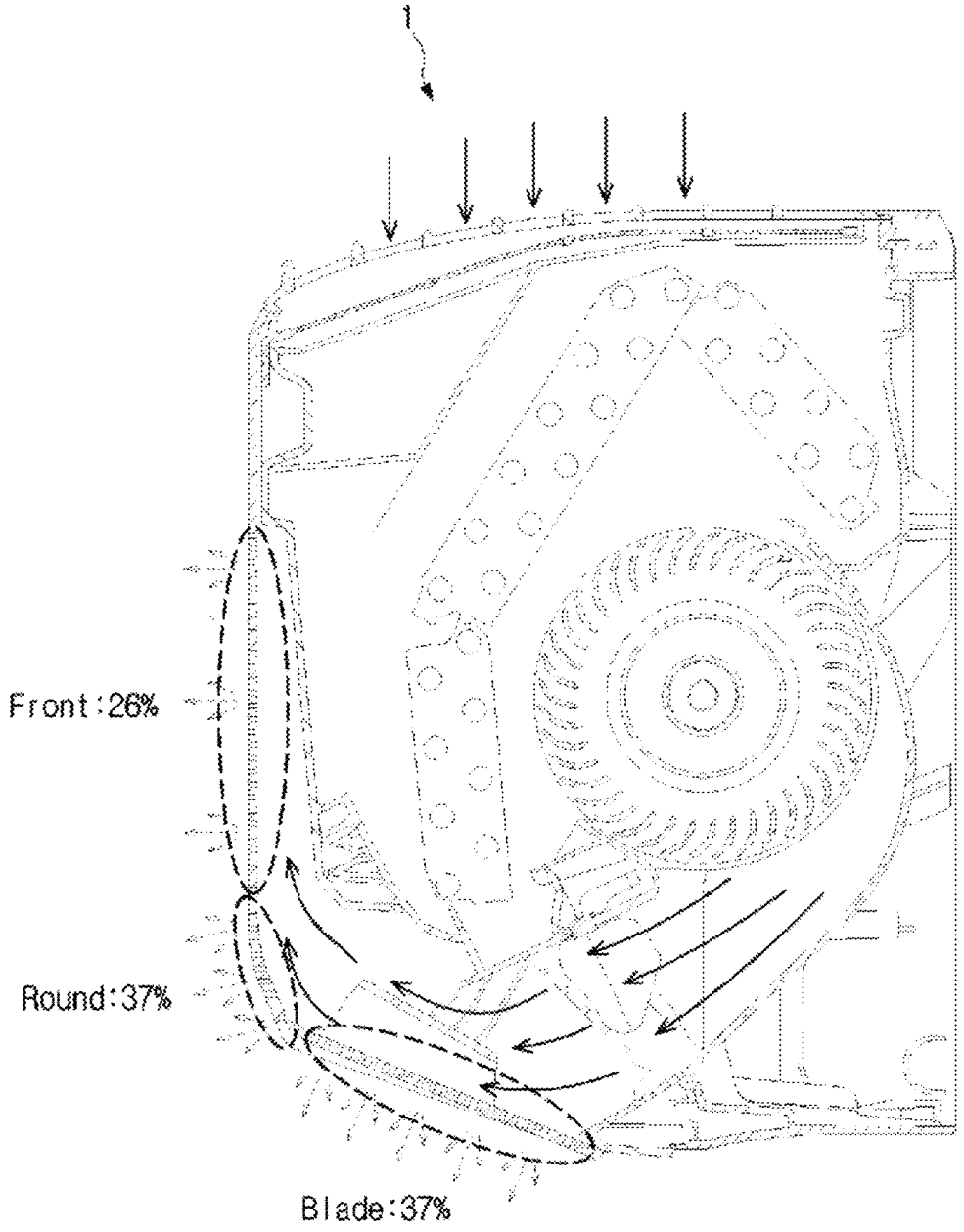
FIG. 6 is a cross-sectional view of the air conditioner of FIG. 5 illustrating amounts of air flows discharged through the air discharge plate and the blade holes.
Figure 8:
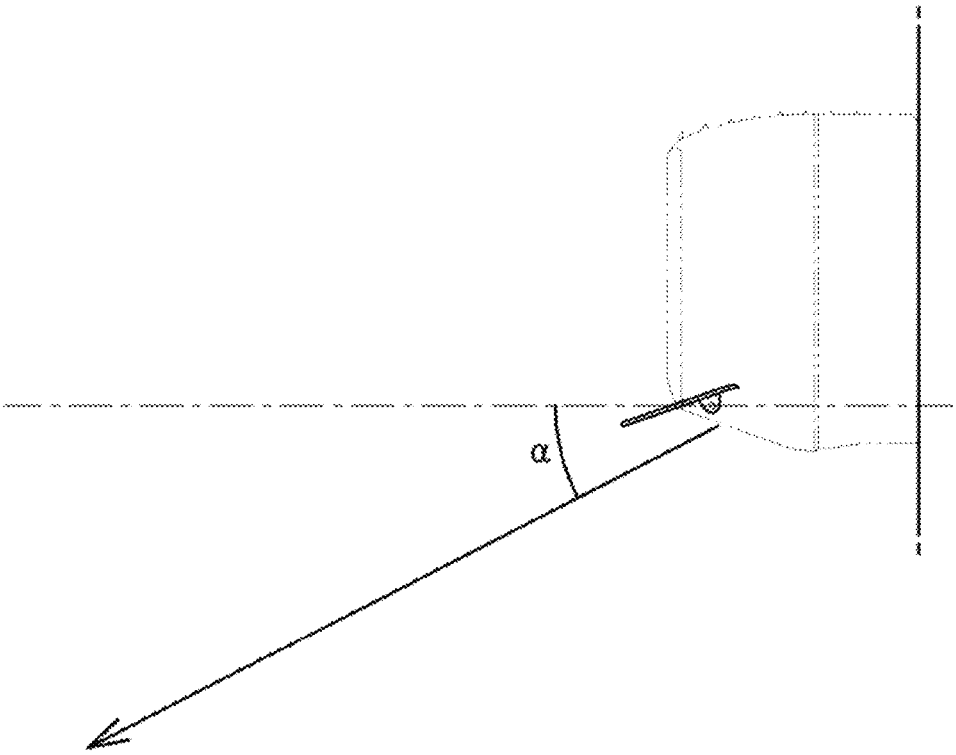
FIG. 8 is a diagram schematically illustrating a direction of air discharged by a conventional air conditioner.
Figure 9:
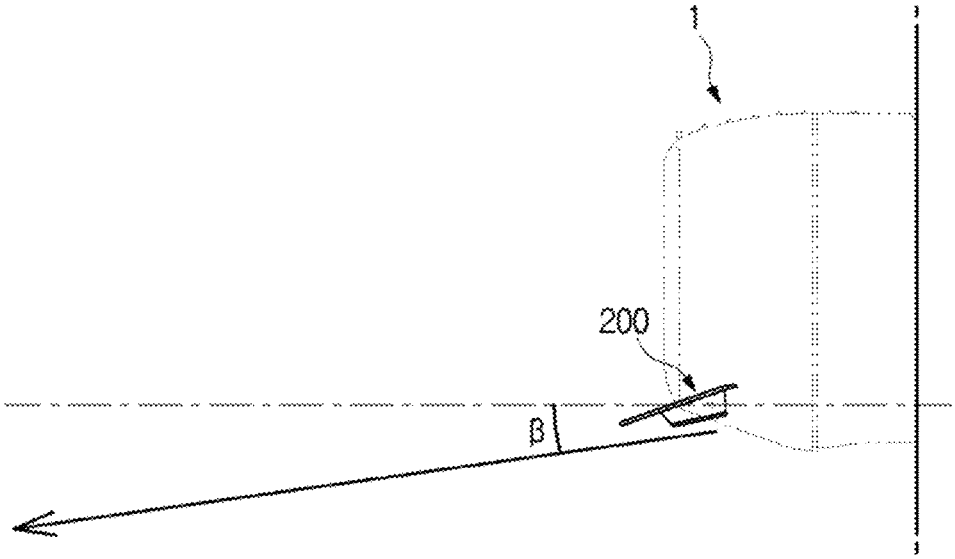
FIG. 9 is a diagram schematically illustrating a direction of air discharged by the air conditioner according to the embodiment.

FIG. 5 illustrates a cross-sectional view of an air conditioner according to an embodiment operating in a minimum air volume mode. FIG. 6 is a cross-sectional view of the air conditioner of FIG. 5 illustrating amounts of air flows discharged through the air discharge plate and the blade holes. FIG. 7 illustrates a cross-sectional view of the air conditioner operating in a straight-ahead mode. FIG. 8 is a diagram schematically illustrating a direction of air discharged by a conventional air conditioner. FIG. 9 is a diagram schematically illustrating a direction of air discharged by the air conditioner according to the embodiment. FIG. 10 is a cross-sectional view illustrating a downdraft mode of the air conditioner according to the embodiment.

Hereinafter, the structure and functions of the blade according to an embodiment will be described in more detail with reference to FIGS. 5 to 10.

As illustrated in FIGS. 5 to 10, the air conditioner 1 according to an embodiment may operate in the minimum air volume mode, the straight-ahead mode, or the downdraft mode.

The minimum air volume mode refers to an operation state in which the blade 100 closes the outlet 14. The straight-ahead mode refers to an operation state in which the blade 100 opens the outlet 14 and guides air blown from the blower fan straight ahead from the outlet 14. The downdraft mode refers to an operation state in which the blade 100 opens the outlet 14 and guides air blown from the blower fan downward from the outlet 14.

When the air conditioner 1 according to the present embodiment operates in the minimum air volume mode, the first blade 110 closes the outlet 14. In this case, the second blade 120 spaced apart from the first blade 110 may guide air blown from the blower fan 30 toward the air discharge plate 12. In other words, the second blade 120 may guide a part of air having passed through the first air flow path 71 toward the second air flow path 72. Thus, air heat-exchanged by the heat exchanger may be appropriately distributed to the blade holes 111 and the plurality of holes 13 of the air discharge plate 12 and discharged therethrough. Since a convention single blade structure does not include a component guiding heat-exchanged air to an air discharge plate, most of the heat-exchanged air is discharged through blade holes. In this case, the effects of the minimum air volume mode in which heat-exchanged air is discharged through a wide area at a low velocity may not be properly obtained. When most of heat-exchanged air is discharged through the blade holes, a velocity of air passing through the blade holes does not decrease to a level desired by a designer and users may not recognize a difference between a normal wind mode and the minimum air volume mode. Thus, in case of the minimum air volume mode, heat-exchanged air is used to be discharged through not only the blade holes 111 but also the plurality of holes 13 of the air discharge plate 12. Since the second blade 120 guides air inside the housings 10 and 20 toward the air discharge plate 12, an amount of air discharged out of the housings 10 and 20 through the plurality of holes 13 of the air discharge plate 12 increases. Thus, an amount of air discharged through the blade holes 111 decreases. As a result, heat-exchanged air is uniformly discharged through a wide area. Thus, the second blade 120 may appropriately distribute the air inside the housings 10 and 20 in the minimum air volume mode to improve the effects of the minimum air volume mode.

According to an embodiment, it may be confirmed that an amount of air discharged through the plurality of holes 13 provided in the air discharge plate 12 increases based on experimental data. Particularly, although not shown in the drawings, in a conventional single plate structure, an amount of air discharged through a front portion of an air discharge plate accounts for 23% of a total amount of air and an amount of air discharged through a round portion disposed under the air discharge plate accounts for 20% of the total amount of air in a conventional single blade structure. In this case, the amount of air discharged through the blade holes accounts for 57% of the total amount of air.

In a double blade structure according to the present disclosure, as illustrated in FIG. 6, an amount of air discharged through a front portion of the air discharge plat accounts for 26% of a total amount of air an amount of air discharged through a round portion located under the air discharge plate accounts for 37% of the total amount of air, and an amount of air discharged through the blade holes accounts for 37% of the total amount of air which is less than that of the single blade structure by about 20%. Thus, according to the present embodiment, the amount of air discharged respectively through the front portion of the air discharge plate, the round portion, and the blade holes are relatively uniform. That is, the heat-exchanged air may be uniformly discharged through a wider area in comparison with the conventional structure.

As illustrated in FIG. 7, when the air conditioner 1 operates in the straight-ahead mode, the second blade 120 may prevent air from being discharged through the blade holes 111 of the first blade 110 at a low speed and guide air to be discharged faster and farther forward from the outlet 14.

Heat-exchanged air may be discharged faster and farther through the outlet in the straight-ahead mode unlike the minimum air volume mode. This is because users using the straight-ahead mode are likely to expect faster cooling effects via direct exposure to the heat-exchanged air. Thus, in the straight-ahead mode, the second air flow path 72 connected to the air discharge plate 12 may be blocked.

According to an embodiment, in the straight-ahead mode, the first blade 110 may be disposed to block an airflow toward the second air flow path 72. That is, the first blade 110 may be disposed to close the second air flow path 72. Although the blade blocks the second air flow path, the conventional single blade cannot prevent air from flowing through the plurality of blade holes formed in the blade and flowing to the second air flow path, and thus an amount of air discharged through the outlet may decrease.

According to the present embodiment, a second bladed integrated with the first blade 110 and rotating together with the first blade 110 may be provided. The second blade 120 may be located below the first blade 110 in the straight-ahead mode. The second blade 120 may prevent an ascending air flow toward the first blade 110 from flowing into the first blade 110. The second blade 120 may guide the ascending air to be discharged straight ahead of the outlet 14. Thus, the amount of air discharged sequentially through the first blade 110, the second air flow path 72, and the plurality of holes 13 of the air discharge plate 12 may be reduced. Thus, an amount of air discharged through the outlet 14 may be increased.

The blade 100 may include a connecting blade 121 connecting the first blade 110 with the second blade 120. The connecting blade 121 may be located approximately perpendicular to the first blade 110 and the second blade 120. The connecting blade 121 and the second blade 120 may be provided plural in number and the number of the connecting blade 121 may be twice that of the second blade 120 to form two side surfaces of the second blade 120. In addition, the plurality of second blades 120 may be arranged along a lengthwise direction of the first blade 110 and the rotary shaft 101 of the blade 100 may be located at the connecting blade 121. In this case, the rotary shaft 101 may be located closer to a front end of the outlet 14 than a rear end of the outlet 14. With this arrangement, the first blade 110 may rotate about the rotary shaft 101 to close the second air flow path 72.

The first blade 110, the second blade 120, and the connecting blade 121 may form an inflow port 122 through which air flows in and an outflow port 123 through which air flows out. However, the inflow and the outflow of air are defined based on the straight-ahead mode illustrated in FIG. 6, and the concept of the inflow port and the outflow port may vary according to arrangement of the blade 100.

As illustrated in FIG. 7, the outflow port 123 may be smaller than the inflow port 122. In other words, the second blade 120 may be aligned to be inclined with respect to the first blade 110. Referring to FIG. 6, a distance between the second blade 120 and the first blade 110 may decrease from one end of the first blade 110 located inside the housings 10 and 20 to the other end of the first blade 110 located outside the first blade 110.

According to the above-described structure, the outflow port 123 is smaller than the inflow port 122. As an area through which air passes increases, a velocity of air decreases in an incompressible flow with a constant density. Thus, a velocity of air discharged out of the outflow port 123 is greater than that of air flowing into the inflow port 122. Thus, in the straight-ahead mode, the second blade 120 may not only prevent the heat-exchanged air from flowing toward the air discharge plate 12 but also guide the heat-exchanged air to be discharged farther forward from the outlet 14 at a higher speed.

Referring to FIGS. 8 and 9, a proceeding direction of discharged air may vary according to the presence or absence of the second blade. FIGS. 8 and 9 illustrates analysis data of cooling air flows according to the presence or absence of the second blade. Referring to FIGS. 8 and 9, the double blade structure according to the present embodiment has a higher tendency of discharged air to go straight than the conventional single blade structure. In case of the conventional single blade structure, an angle between the horizontal line and the proceeding direction of discharged air is $\alpha$. In the double blade structure, the angle between a horizontal line and the proceeding direction of discharged air is $\beta$. As illustrated in FIGS. 8 and 9, $\alpha$ is greater than $\beta$. Since the tendency to go straight is increased as the angle decreases, it is confirmed that the double blade structure has a higher tendency to go straight than the conventional single blade structure.

Referring to FIG. 10, the air conditioner 1 may operate in the downdraft mode. In general, the downdraft mode may be used for heating operation of the air conditioner 1. Since cool air with a higher density flows down and warm air with a lower density flows up, warm air may be discharged downward during a heating operation. By discharging warm air downward, heat exchange with cool air may be efficiently performed, and thus the entire indoor space may be uniformly heated.

In the case where the rotary shaft 101 of the blade 100 is located closer to the rear end of the outlet 14 than the front end, air discharged through the outlet 14 cannot be guided downward even when the blade 100 rotates. Since the rotary shaft 101 of the blade 100 is located closer to the front end of the outlet 14 than the rear end according to an embodiment, the blade 100 may guide air discharged through the outlet 14 downward.

In addition, in case of the conventional single blade structure, although a rotary shaft is located closer to a front end of the outlet and air is guided downward, the heat-exchanged air passes through the blade holes and flows upward. Warm air cannot exchange heat with cool air of the indoor space under the air conditioner and is re-introduced into the inlet. When the warm air is re-introduced into the inlet, heating performance may deteriorate due to a low temperature difference between the re-introduced air and the heat exchanger.

According to the present disclosure, the second blade 120 may prevent deterioration of heating performance. Particularly, the second blade 120 guides air, which passes through the outlet 14 and flows toward the first blade 110, downward, to prevent an air flowing toward the blade holes 111 of the first blade 110. Thus, a leaked airflow passing through the blade holes 111 may be reduced and deterioration of heating performance may be prevented. That is, heating performance may be improved.

As described above, since the air conditioner 1 according to an embodiment includes the second blade 120 spaced apart from the first blade 110, deterioration of heating performance may be prevented, the tendency of discharged air to go straight may be reinforced, and performance of the minimum air volume mode may be improved. Since the second blade 120 is integrated with the first blade 110 and moves simultaneously with the first blade 110, a separate motor to drive the second blade 120 is not required. That is, the aforementioned effects may be obtained by using a simple structure with no additional components.

Figure 11:
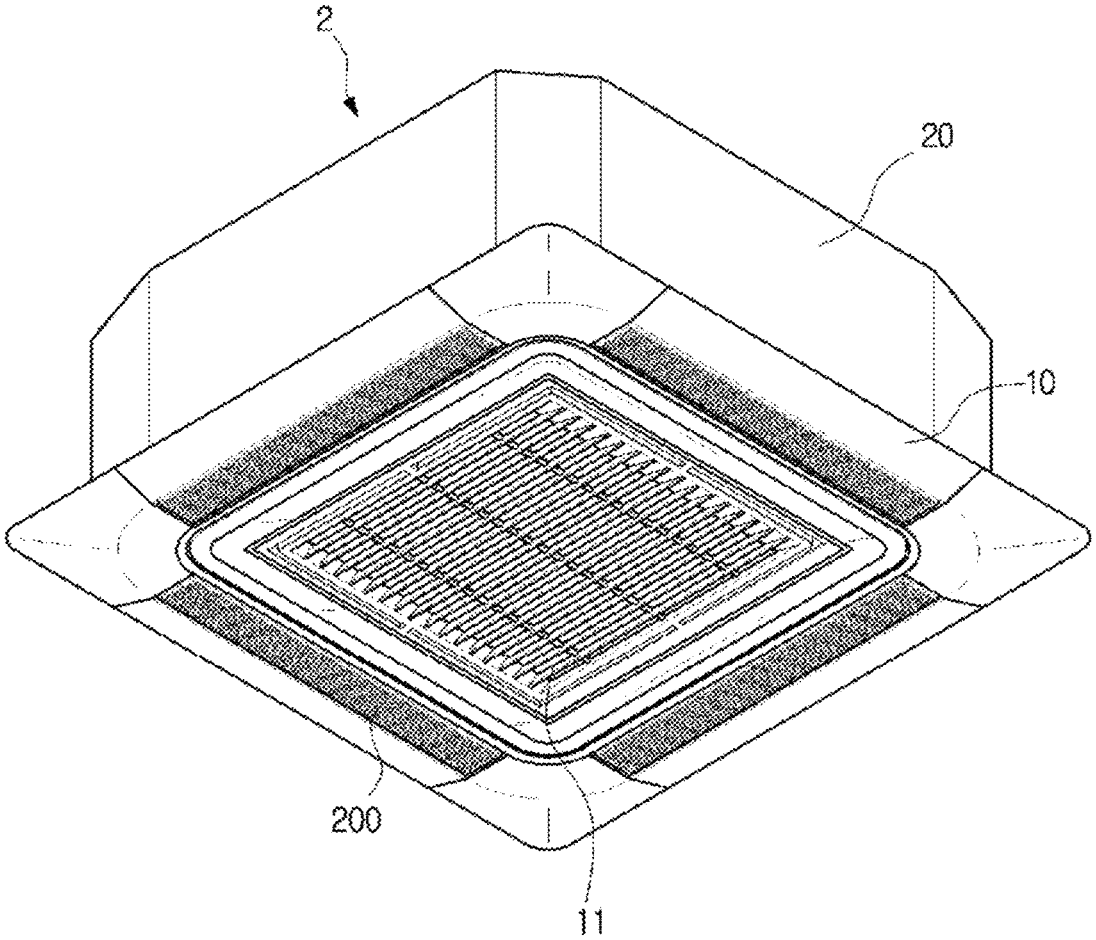
FIG. 11 illustrates a bottom perspective view of an air conditioner according to another embodiment of the present disclosure.
Figure 12:
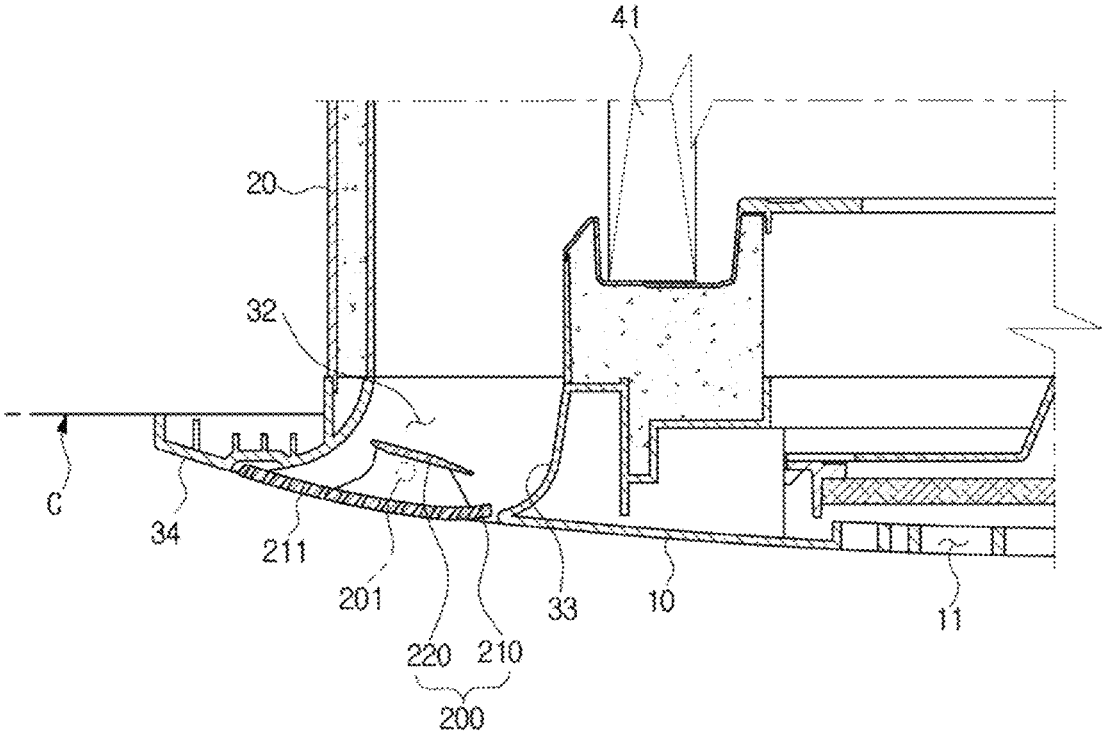
FIG. 12 illustrates a cross-sectional view of the air conditioner operating in a minimum air volume mode.
Figure 13:
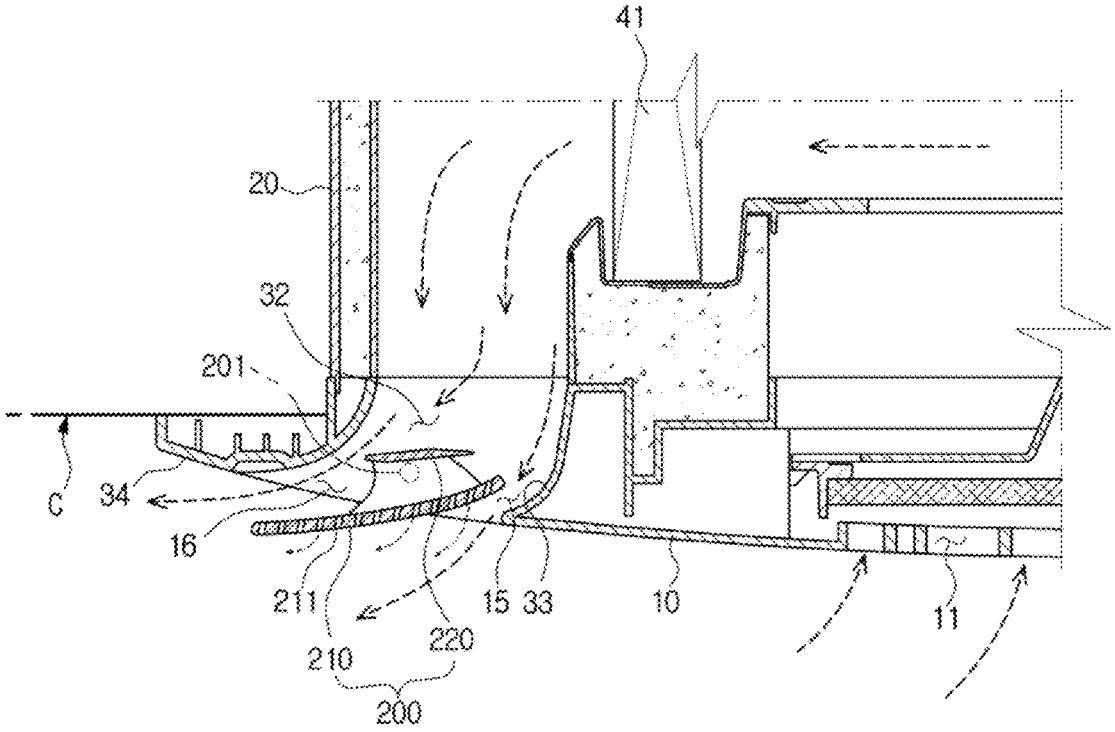
FIG. 13 illustrates a cross-sectional view of the air conditioner operating in a straight-ahead mode.

FIG. 11 illustrates a bottom perspective view of an air conditioner according to another embodiment of the present disclosure. FIG. 12 illustrates a cross-sectional view of the air conditioner operating in a minimum air volume mode. FIG. 13 illustrates a cross-sectional view of the air conditioner operating in a straight-ahead mode.

Referring to FIGS. 11 to 13, an air conditioner 2 according to another embodiment will be described.

The air conditioner 2 includes housings 10 and 20 recessed in or mounted on a ceiling C, a heat exchanger 41 provided inside the housings 10 and 20, and a blower fan (not shown) configured to draw air into the housings 10 and 20 through an inlet port 11 and discharge air out of the housings 10 and 20 through an air discharge port 32.

The housings 10 and 20 may have a rectangular box shape opened downward such that components of the air conditioner 2 are accommodated therein. The housings 10 and 20 may include an upper housing 20 recessed in the ceiling C and a lower housing 10 coupled to lower portions of the upper housing 20. Also, the upper housing 20 may not be recessed in the ceiling C but mounted on the ceiling C.

The inlet port 11 through which air is sucked may be formed at a central region of the lower housing 10 and the air discharge port 32 through which air is discharged may formed at outer sides of the inlet port 11.

The air discharge ports 32 may be formed adjacent to the respective edges of the lower housing 10 to correspond to outer sides thereof. Four air discharge ports 32 may be formed. The air discharge ports 32 are arranged to discharge air in all directions. According to this structure, the air conditioner 2 may suck air from a portion thereunder, cool or heat the air, and discharge the cooled air or heated air downward.

A grille may be coupled to the bottom surface of the lower housing 10 to remove dusts from air sucked through the inlet port 11.

The heat exchanger 41 may be formed in a rectangular ring and located at an outer portion than the blower fan in the housings 10 and 20. The shape of the heat exchanger 41 is not limited to the rectangular ring and may also be various shapes such as a circular, an oval, or a polygonal shape.

The air conditioner 2 may include a blade 200 configured to open or close the air discharge port 32. The blade 200 may be provided rotatably about a rotary shaft 201. The blade 200 may rotate about the rotary shaft 201 to open or close the air discharge port 32.

The blade 200 may include a first blade 210 having a size corresponding to that of the air discharge port 32 and a second blade 220 spaced apart from the first blade 210.

The first blade 210 may have a plurality of blade holes 211 penetrating the first blade 210 to allow air to pass therethrough. When the first blade 210 closes the air discharge port 32, air blown from the blower fan may be discharged out of the housings 10 and 20 through the blade holes 211. Since the blade holes 211 are far smaller than the air discharge port 32, a velocity of air passing therethrough may considerably decrease. This is defined as minimum air volume mode. In the minimum air volume mode, the velocity of air is very low, and thus a user may not be exposed to direct wind with no cold feelings and uncomfortable feelings.

In the minimum air volume mode, the second blade 220 may guide air toward the blade holes 211. The second blade 220 may form a flow guide path together with the first blade 210 and guide air to the blade holes 211. As the flow guide path is formed, air is guided to the blade holes 211 provided adjacent to the other end of the first blade 210. When there is no flow guide, an amount of air flowing toward the blade holes 211 located at a far position from the blower fan decreases, and thus most of air is discharged through the blade holes 211 located at a predetermined area of the first blade 210. Since the flow guide path is formed, air may be discharged out of the housings 10 and 20 through the blade holes 211 in all areas of the first blade 210.

As illustrated in FIG. 13, the blade 200 may rotate about the rotary shaft 201 to open the air discharge port 32. In this case, since the blade 200 does not close the air discharge port 32, air may be discharged directly through the air discharge port. This is defined as a straight-ahead mode.

When the first blade 210 opens the air discharge port 32, a first opening 15 may be formed between one end of the blade 200 closer to the inlet port 11 and the lower housing 10. A portion of the lower housing 10 forming the first opening 15 will be referred to as a first guide portion 33.

When the first blade 210 opens the air discharge port 32, a second opening 16 may be formed between the other end of the blade 200 and the lower housing 10. A portion of the lower housing 10 forming the second opening 16 will be referred to as second guide portion 34.

The second blade 220 may be formed to reduce an amount of air passing through the blade holes 211 when the first blade 210 opens the air discharge port 32. In addition, the second blade 220 may guide air inside the housings 10 and 20 toward the first opening 15 and the second opening 16 when the first blade 210 opens the air discharge port 32. Thus, an amount of air discharged through the first opening 15 and the second opening 16 may be increased.

When a conventional single blade opens an air discharge port, air is discharged through the blade holes 211 even in the straight-ahead mode. An amount and velocity of air discharged through the first opening 15 and the second opening 16 are relatively low. Thus, air passing through the first opening 15 and the second opening 16 is re-introduced through the inlet port 11 by the blower fan and condensation occurs on the bottom surfaces of the housings 10 and 20 in a process of re-introducing cool air through the inlet port 11. When the condensation phenomenon becomes serious, water droplets fall from the air conditioner 2 causing uncomfortable feelings to the user. In addition, when the heat-exchanged air does not exchange heat with indoor air but re-introduced into the inlet port, cooling or heating performance may deteriorate due to a low temperature difference between the re-introduced air and the heat exchanger.

According to the present embodiment, the second blade 220 spaced apart from the first blade 210 may guide the heat-exchanged air to the first opening 15 and the second opening 16. In particular, the second blade 220 may guide the heat-exchanged air to the second opening 16 farther than the first opening 15 from the inlet port 11. Thus, an amount of air discharged through the first opening 15 and the second opening 16 increases and an amount of air discharged through the blade hole 211 decreases. Since the amount of air discharged through the first opening 15 and the second opening 16 increases, the sizes of the first opening 15 and the second opening 16 are the same, and air has a constant density, a velocity of air passing through the first opening 15 and the second opening 16 increases. Air discharged through the blade holes 211 flows at a lower velocity and has a relatively low tendency to go straight. On the contrary, air guided to the first opening 15 and the second opening 16 by the second blade 220 and discharged through the first opening 15 and the second opening 16 flows at a higher velocity and a relatively high tendency to go straight. Therefore, most of the heat-exchanged air may be discharged in a direction away from the inlet port through the first opening 15 and the second opening 16 in the straight-ahead mode.

The first guide portion 33 forming the first opening 15 together with the first blade 210 may guide air such that air discharged through the first opening 15 pushes air discharges through the blade holes 211 in a direction away from the inlet port 11. Particularly, the first guide portion 33 may guide air discharged through the first opening 15 to push air discharged through the blade holes 211 in a direction away from the inlet port 11. As described above, a velocity of air passing through the first opening 15 increases by the second blade 220 and is greater than a velocity of air passing through the blade holes 211. Since the velocity of air passing through the first opening 15 is greater than that of air passing through the blade holes 211 and a direction of air passing through the first opening 15 is a direction away from the inlet port 11, air having passed through the blade holes 211 is absorbed into air having passed through the first opening 15 and flows in the direction away from the inlet port 11. Thus, air is not re-introduced into the inlet port after passing through the blade holes 211 or through the first opening 15. When air is re-introduced into the inlet port 11 after passing through the blade holes 211 or the first opening 15 as described above, condensation may occur on the bottom surface of the housings 10 and 20 and cooling performance may deteriorate. According to present disclosure, re-introduction of air into the inlet port 11 is prevented and thus condensation does not occur and cooling performance may not deteriorate.

The second blade 220 may be located closer to one end of the first blade 210 to increase an amount of air discharged through the second opening 16. Thus, an amount of air discharged through the first opening 15 may slightly decrease. However, the amount of air discharged through the second opening 16 may further increase and a velocity of air discharged through the second opening 16 may also increase. As described above, the heat-exchanged air may be discharged through the second opening 16 farther from the inlet port 11. As the amount of air discharged through the second opening 16 increases, re-introduction of the heat-exchanged air into the inlet port may be efficiently prevented.

The second blade 220 may be integrated with the first blade 210 to rotate about the rotary shaft 201. That is, the air conditioner 2 does not need separate power to drive the second blade 220. Also, the air conditioner 2 may efficiently control air flows by using a simple integrated structure. As described above, the second blade 220 may prevent deterioration of cooling performance and condensation by controlling the air flows.

Figure 14:
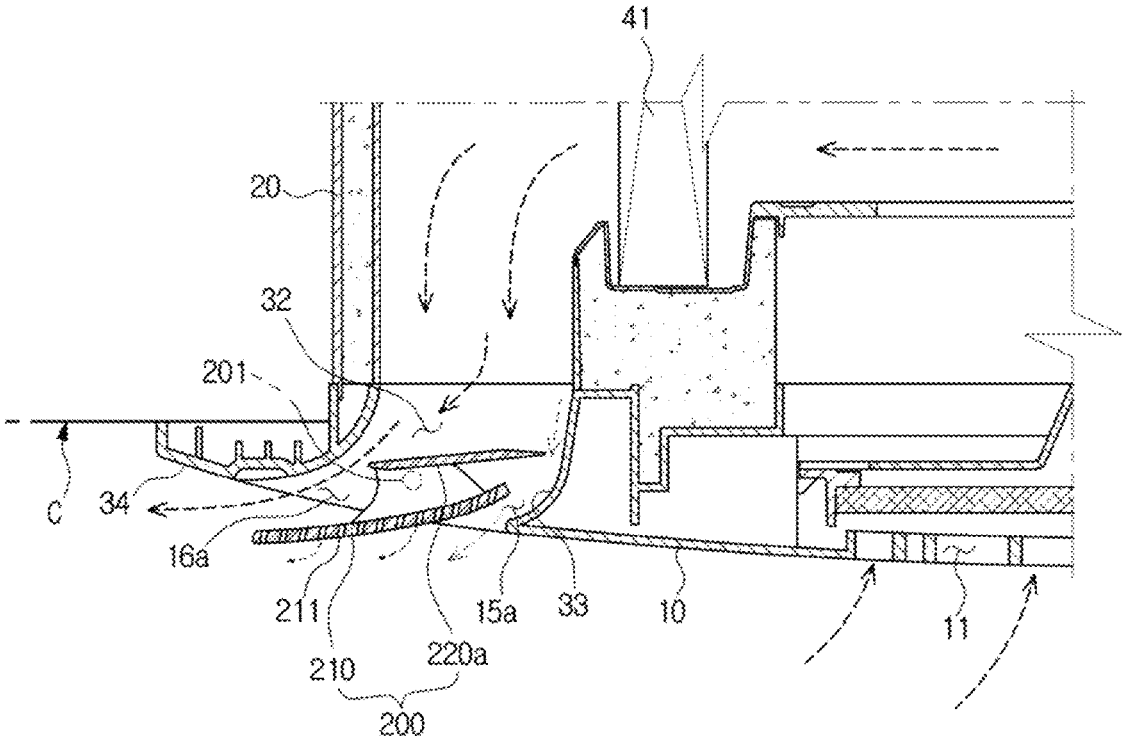
FIG. 14 illustrates a cross-sectional view of an air conditioner according to another embodiment operating in a straight-ahead mode.

FIG. 14 illustrates a cross-sectional view of an air conditioner according to another embodiment operating in a straight-ahead mode.

Hereinafter, since other components except for the second blade **220*a*** are the same as those described above, and thus detailed descriptions thereof will not be repeated.

As illustrated in FIG. 14, a second blade **220*a* may extend toward a first opening 15*a* in a straight-ahead mode. By using this structure, the second blade 220*a* may increase an amount of air discharged through the second opening 16*a*. When the second blade 220*a* extends toward the first opening 15*a*, the second blade 220*a* blocks a part of an inflow portion (or upper portion) of the first opening 15*a*. When a part of the inflow portion (or upper portion) of the first opening 15*a* is blocked, an amount of air discharged through the first opening 15*a* decreases. Since the amount of air discharged through the air discharge port 32 is uniform, the amount of air discharged through the second opening 16*a* increases. Thus, according to the embodiment, the amount of air discharged through the second opening 16*a*** may increase and a tendency of the discharged air to go straight may be improved.

As is apparent from the above description, the air conditioner according to an embodiment may blow heat-exchanged air in different manners according to an environment of use.

The air conditioner according to an embodiment may discharge heat-exchanged air at different velocities.

The air conditioner according to an embodiment may prevent deterioration of cooling or heating performance caused by re-introduction of heat-exchanged air into the heat exchanger.

Although the present disclosure has been described with various embodiments, various changes and modifications may be suggested to one skilled in the art. It is intended that the present disclosure encompass such changes and modifications as fall within the scope of the appended claims.

What is claimed is:

1. An air conditioner comprising:

a housing comprising an air discharge plate that comprises a plurality of holes and an outlet;

a heat exchanger located inside the housing;

a blower fan configured to blow air heat-exchanged with the heat exchanger toward the air discharge plate or the outlet; and a blade configured to rotate about a rotary shaft between (i) a guide position to guide a direction of air blown from the blower fan and discharged through the outlet and (ii) a closing position to close the outlet, wherein the blade comprises:

a first blade comprising a plurality of blade holes and a size corresponding to that of the outlet, the first blade configured to rotate about the rotary shaft, and a second blade spaced apart from the first blade and configured to guide air blown from the blower fan toward the air discharge plate when the first blade is located at the closing position, the second blade configured to rotate about the rotary shaft.

2. The air conditioner of claim 1, wherein the second blade is integrated with the first blade and is configured to move together with the first blade to the guide position or the closing position.

3. The air conditioner of claim 1, further comprising a connecting blade connecting the first blade with the second blade.

4. The air conditioner of claim 3, wherein the connecting blade forms an inflow port through which air flows in and an outflow port through which air is discharged together with the first blade and the second blade.

5. The air conditioner of claim 4, wherein the outflow port is smaller than the inflow port in order to allow a velocity of air discharged out of the outflow port to be greater than a velocity of air introduced into the inflow port.

6. The air conditioner of claim 3, wherein the rotary shaft of the blade is located at the connecting blade.

7. The air conditioner of claim 6, wherein the rotary shaft of the blade is located closer to a front end of the outlet than a rear end of the outlet.

8. The air conditioner of claim 1, wherein the second blade comprises a plurality of second blades arranged along a lengthwise direction of the first blade.

9. The air conditioner of claim 1, wherein the second blade is configured to reduce an amount of air passing through the blade holes of the first blade among air flows blown from the blower fan when the blade is located in the guide position.

10. The air conditioner of claim 1, wherein the second blade is inclined with respect to the first blade.

11. An air conditioner comprising:

a housing mounted on or recessed in a ceiling and comprising an inlet port and an air discharge port;

a heat exchanger located inside the housing;

a blower fan configured to draw air into the housing through the inlet port and discharge air out of the housing through the air discharge port;

a first blade including a plurality of blade holes and configured to rotate about a rotary axis to open or close the air discharge port, and discharge air through the plurality of blade holes; and a second blade spaced apart from the first blade and configured to reduce an amount of air passing through the blade holes when the first blade opens the air discharge port and rotate about the rotary axis.

12. The air conditioner of claim 11, further comprising:

a first opening formed between one side of the first blade closer to the inlet port and the housing when the first blade opens the air discharge port; and a second opening formed between another side of the first blade opposite to the one side and the housing when the first blade opens the air discharge port.

13. The air conditioner of claim 12, wherein the second blade is configured to increase an amount of air discharged through the first opening and the second opening by guiding air inside the housing toward the first opening and the second opening.

14. The air conditioner of claim 12, wherein the housing comprises a guide portion configured to guide air discharged through the first opening in a direction away from the inlet port.

15. The air conditioner of claim 14, wherein when the first blade opens the air discharge port, the second blade is configured to guide air toward the guide portion and the guide portion is configured to guide air discharged through the first opening to push air discharged through the blade holes in a direction away from the inlet port.

16. The air conditioner of claim 12, wherein when the first blade opens the air discharge port, a velocity of air discharged through the first opening is greater than a velocity of air discharged through the blade holes.

17. The air conditioner of claim 12, wherein the second blade is located closer to one side of the first blade to increase an amount of air discharged through the first opening.

18. The air conditioner of claim 11, wherein the second blade forms a flow guide configured to guide air toward the blade holes when the first blade closes the air discharge port.

19. The air conditioner of claim 11, wherein the second blade comprises a plurality of second blades arranged along a lengthwise direction of the first blade.

20. The air conditioner of claim 11, wherein the second blade is integrated with the first blade to rotate together therewith.

* * * * *